US006213358B1

(12) United States Patent
Libit et al.

(10) Patent No.: US 6,213,358 B1
(45) Date of Patent: Apr. 10, 2001

(54) MOLDED BOTTLE WITH INCLINED SPRAY TUBE

(75) Inventors: Jeffrey M. Libit, 407 Seventh St., NW., Albuquerque, NM (US) 87102; Sidney M. Libit, Longboat Key, FL (US)

(73) Assignee: Jeffrey M. Libit, Albuquerque, NM (US)

( * ) Notice: Subject to any disclaimer, the term of this patent is extended or adjusted under 35 U.S.C. 154(b) by 0 days.

(21) Appl. No.: 09/375,831

(22) Filed: Aug. 16, 1999

(51) Int. Cl.[7] ..... B67F 5/42; B65D 37/00

(52) U.S. Cl. ..... 222/633; 222/207; 222/210; 222/215

(58) Field of Search ..... 222/207, 210, 222/211, 215, 382, 633

(56) References Cited

U.S. PATENT DOCUMENTS 178,096 * 5/1876 Ballou et al. ..... 222/207
644,131 * 2/1900 Ertsman ..... 222/207
4,418,843 * 12/1983 Jackman ..... 222/207
5,289,948 * 3/1994 Moss et al. ..... 222/207
5,558,257 * 9/1996 Braun ..... 222/212
5,638,994 * 6/1997 Libit et al. ..... 222/207

* cited by examiner

*Primary Examiner*—Kevin Shaver
*Assistant Examiner*—David Deal
(74) *Attorney, Agent, or Firm*—Larry L. Saret; Laff, Whitesel & Saret, Ltd.

(57) ABSTRACT

A plastic bottle for spraying liquid has a liquid chamber defined by a sidewall. The sidewall terminates in a neck having a neck opening. A tube integrally formed alongside the sidewall leads from the bottom of the liquid chamber up to a nozzle. A top end of the tube is inclined away from the neck, and a squeeze bulb is in liquid communication with the tube. By squeezing the squeeze bulb, liquid is drawn from the liquid chamber, through the tube, and out through a nozzle attached to the top end of the tube.

8 Claims, 4 Drawing Sheets

MOLDED BOTTLE WITH INCLINED SPRAY TUBE

FIELD OF THE INVENTION

This invention relates generally to plastic spray bottle and, more particularly, to plastic bottles having an integrally molded squeeze bulb pump along a spray tube inclined relative to the neck of the bottle.

BACKGROUND OF THE INVENTION

A background of relevant information may be gained from a review of the following U.S. Pat. Nos.: 4,418,843; 4,603,794; 4,972,977; 5,129,550; 5,289,948; 5,558,257; and 5,638,994.

A window cleaner spray bottle is an example of the kind of spray bottles which the present invention addresses. Hard surface sprayers, hair and cosmetic sprayers, and pesticide sprayers are additional examples of applications addressed by this invention.

Conventional spray bottles such as these, however, have numerous parts and are relatively expensive to manufacture and assemble. In fact, the spray mechanisms of these bottles often cost more than the product contained within the bottle. Also, the spray bottles are usually relatively complicated, so that many small parts must be handled and assembled during manufacture. For example, many spray mechanisms include piston-style pumps, trigger handles, tubes, and nozzles enabling variable spray configurations. Moreover, because some probability of failure during operation exists for each part, there are almost certainly a higher than necessary number of faulty bottles.

Another problem associated with conventional spray bottles is that some of the product is wasted. For example, a conventional window cleaner spray bottle contains a tube in the center of the bottle for drawing liquid up and into the spray mechanism. The tube stops short of the bottom of the bottle so that the bottom does not block liquid from flowing into the tube. Thus, when the bottle is almost empty, any liquid below the tube will remain in the bottle. Also, if more than the desired amount of product may be sprayed upon each application, there is a resulting waste, because neither the volume of the product to be delivered nor the duration of the spray can be easily controlled.

An additional important consideration is the spray bottle's be ease of use. Many people, especially the elderly and people with arthritic hands, may have difficulty manipulating conventional trigger sprayers. A significant force is required to depress the trigger of some spray bottles. Thus, it is desirable to provide a spray bottle with a trigger that may either be finger-driven or palm-driven and which achieves many available pounds per square inch (PSI) for spraying the liquid. It would also be desirable if the trigger included a finger grip configuration to insure proper placement of the user's hand, to improve user comfort, and to make the trigger easier to hold and squeeze.

Another consideration with respect to the ease of use involves large capacity sprayers. Large capacity sprayers, such as those currently used in the garden industry, require two hands. The large bottle or container must be carried in one hand, while the sprayer is held in the other. A large capacity spray bottle that can be held in one hand and be either finger-driven or palm-driven would be significantly less cumbersome and more efficient to use.

With the increasing emphasis that is being placed on environmental issues, the ability to refill the spray bottle with more product rather than to dispose of the empty bottle is extremely important. However, because many users may prefer to purchase a new bottle instead, spray bottles should be made of a recyclable material.

Yet another consideration is the cost of manufacturing such a spray bottle. Here, the considerations are directed to lowering a the cost of molds, and further reducing the cost of assembly and of spray bottle parts, such as the cap. However, these cost reductions must not reduce the reliability and serviceability of the spray bottle. For example, it should become easier to fill the bottle. Fewer squeezes should be required to expel the fluid. The spray should be atomized.

U.S. Pat. No. 5,638,994 (Libit et al.) discloses a spray or dispensing bottle with an integrally molded pump spaced apart from the rest of the bottle to permit liquid to be dispensed through the neck and sprayed out the top of the bottle. This bottle design routes the liquid through the neck of the bottle both during filling and dispensing. That is, when the bottle is being filled, the cap covering the neck of the bottle must be removed. Because the siphon tube which dispenses the liquid also extends through the neck and through the cap to the nozzle, the cap requires considerable engineering and cost to permit easy removal and reattachment to ensure that liquid flows as intended during both filling and dispensing. For example, the cap includes a ball valve and the associated tubes, which require more assembly steps than a simple screw-on or hinged cap would require.

Also, this bottle design directs dispensed liquid out through a nozzle in a direction approximately 90 degrees from the vertical. That increases the difficulty of spraying some very high and very low surfaces because the bottle must be tilted by the user to direct the nozzle. This tilting, in turn, may make spraying an awkward, uncomfortable task, and when the fluid level in the bottle is very low, the tilt may prevent liquid from reaching the siphon tube and nozzle.

The molded bottle with trigger bulb pump of the present invention offers improvements to the bottle shown in the Libit et al. patent.

SUMMARY OF THE INVENTION

In keeping with an aspect of the invention, a molded bottle for spraying or dispensing liquids includes a principal liquid chamber defined by a sidewall and a tube which extends alongside the chamber and receives liquid therefrom. The tube has a top end inclined away from the neck of the bottle. A squeeze bulb is connected to the top end of the tube for receiving and holding the liquid which is drawn up the tube when the squeeze bulb is first squeezed and then decompressed. After the squeeze bulb is primed with liquid, any pressure subsequently applied to the squeeze bulb will cause the liquid to be sprayed out the bottle through a one-way exit valve located above the squeeze bulb that keeps air from entering the squeeze bulb during its decompression.

The spray bottle with squeeze bulb is both economically appealing and environmentally acceptable. Aside from being recyclable and refillable, the bottle comprises few parts, requires a minimal amount of assembly and reduces the probability of failure. Moreover, the user can easily select and control the volume and duration of the dispensed product, thereby resulting in less waste. The molded bottle is also easy to use because the top end of the tube and its connected nozzle are inclined at an angle other than 90° relative to the longitudinal axis of the sidewall, thereby making it easier for the user to direct the spray at very low or very high locations.

DETAILED DESCRIPTION OF THE INVENTION

Figure 1:
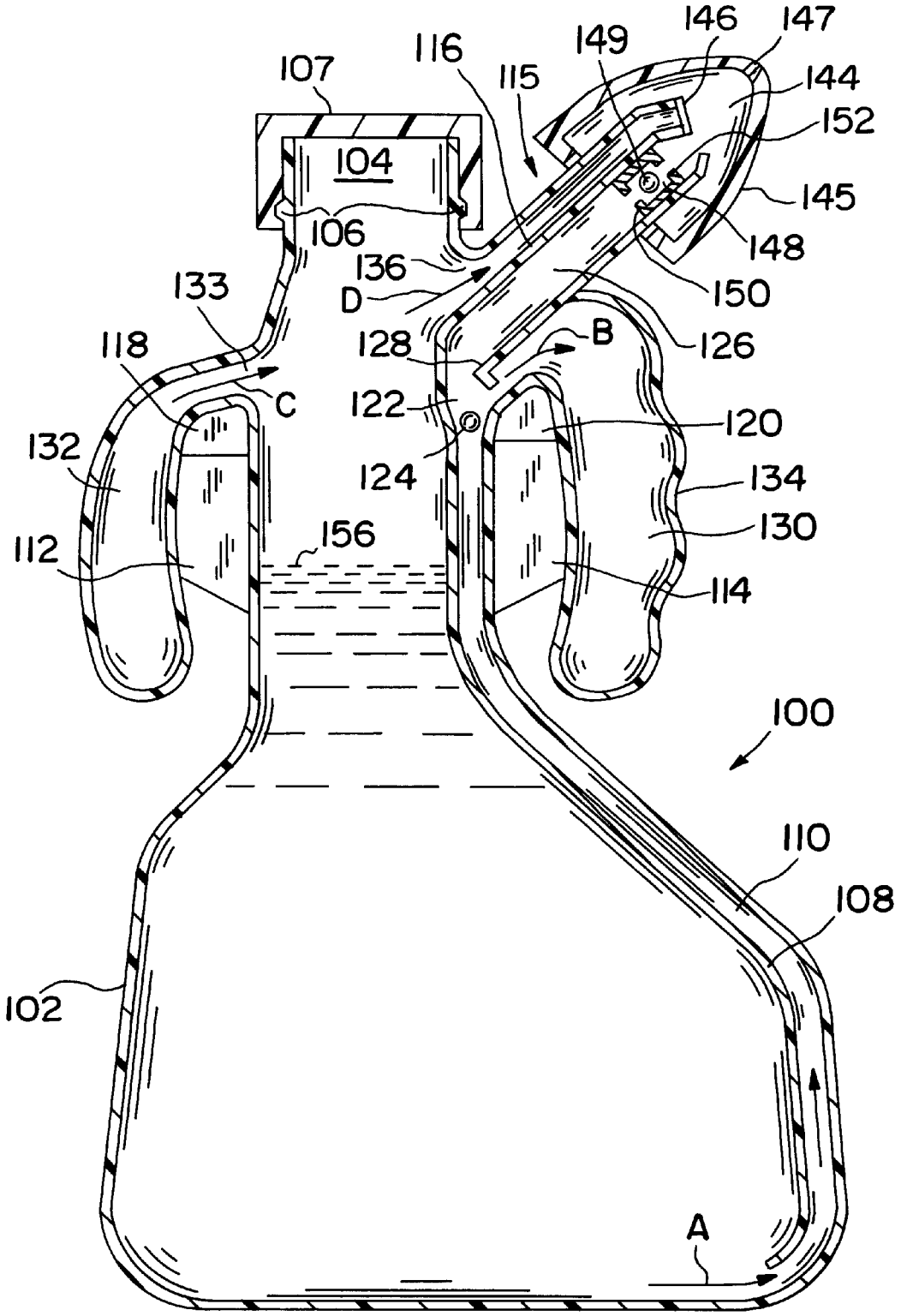
FIG. 1 is a cross-section of a first embodiment of the invention.

The invention is directed to a spray bottle 100, as shown in FIG. 1. The spray bottle 100 is preferably blow-molded, although it may be made by any suitable process. It is preferred that the bottle be made of a plastic which is fairly easy to squeeze, but with a plastic memory sufficient to cause the bottle to return to its original shape when it is released after it has been squeezed. Suitable plastics include substantially all densities of polyethylene, polypropylene, polyethylene terephthalate (PET) and polyvinylchloride (PVC), as well as other plastic compounds.

The embodiment of FIG. 1 discloses a spray bottle which allows the cap to be a simple molded part. Therefore, it may be attached to the bottle in the simplest and most appropriate manner for a given set of circumstances. For example, if the bottle is to be refilled, the cap may be attached by simple screw threads molded around the bottle neck. If it is not to be refilled, the cap may be snapped on. Other examples may include a cap molded as a unit with the bottle and integrally attached thereto by a living hinge. If there is a reason why the bottle should not be opened or refilled, the top may be heat welded or otherwise fixed in place. The point is that any suitable cap connection may be provided after the construction of the cap is simplified.

In greater detail, almost the entire structure 100 shown in FIG. 1 is blow molded in a single step. The major contours are a somewhat conventional bottle wall 102 terminating at the top in a simple neck opening 104. The outside contour 106 of the neck opening may have screw threads or a snap-on circumferential lip or any other suitable cap capture surface for receiving cap 107.

It should be noted that if any liquid is poured into neck 104, there are no obstacles or parts which might divert the fluid. This contrasts with other spray bottles where the fluid dispensing tube also runs through the neck and could interfere with filling.

The mold for making the bottle 100 includes a number of pinched or web forming areas where the opposite sides of the mold are so close to each other that the plastic becomes a solid piece. These areas are formed, for example, at 108 which separates the bottle from a tube 110 that runs from the bottom of the bottle 100 and up a side to a spray head. Other pinched, solid plastic areas 112, 114 form a pair of strengthening ribs which prevents the neck from collapsing when it is squeezed. The web is thicker, and thus stronger, in upper rib areas 118, 120. Another area of solid plastic 116 separates a spout 115 into two channels. Preferably, this spout is horizontal, or slightly inclined upwardly, as shown in FIG. 1.

It should be noted that between the solid areas 108, 114, the tube 110 opens into a somewhat funnel shaped opening 122 in the bottom of which a ball valve is located. This ball 124 may be simply dropped into spout channel 126 after the bottle is blow molded. Ball 124 enables liquid to rise from the bottom of the bottle through tube 110 and into the funnel shaped opening 122 upon squeezing the bottle, but the liquid cannot return from opening 122 and into tube 110 because the ball has a larger diameter than tube 110 and seats itself on top of tube 110 after the bottle is relaxed. A solid plastic shield 128 extends over part of the funnel shaped opening in order to deflect liquid rising through tube 110 into a squeeze bulb 130. The funnel shaped opening 122 extends upwardly and into spout channel 126 which enables a liquid to flow out of the bottle.

On the opposite side of the bottle, another air compressing squeeze bulb or structure 132 is formed to pressurize the bottle. A suitable opening 133 provides communication between bulb 132 and the interior of bottle 100. The bulb 132 is squeezed by the palm of the hand while the bulb 130 is squeezed by the fingers. Therefore, the bulb 130 is molded with suitable finger indentions, as shown at 134, for example, which tends to cause the user to place his hand in a correct location before squeezing the two bulbs 130, 132.

The spout 140 has a longitudinal axis that is inclined relative to the longitudinal axis of bottle wall 102 at an angle substantially different than a 90° angle so as to direct the sprayed liquid 156 at other than a 90° angle. Spout 140 has two channels formed by the pinch area 116. One channel 126 conveys liquid. The other channel 136 conveys air. The liquid and air merge in a spray chamber 144 formed inside a separate spray head nozzle part 145. The interior of a spray housing 144 is simultaneously flooded with liquid and air under augmented pressure which atomizes the liquid. For this atomization, the channel 136 has a relatively small diameter relative to neck opening 104 to increase the velocity of air moving therein. After the air and liquid mix and atomize in spray chamber 144, nozzle 147 issues a spray of the atomized liquid into the ambient atmosphere under the urging of pressure generated by the two squeezed bulbs 130, 132.

Nozzle part 145 is a separate piece part which screws on to the end of the spout and which may be turned to open or close a nozzle opening 147. Inside nozzle 145, a flap valve 146 is joined to the bottle by a living hinge or other check ball valve type feature to preserve augmented pressure by preventing ambient air from feeding back into air channel 136 while the spray chamber is pressurized. However, when the pressure is released, the flap valve 146 opens enough for air to leak into the bottle and replace that which was squeezed from the bottle.

Alternatively, instead of flap valve 146 or a similar device in the nozzle, the cap 107 may have an opening with a valve (not shown) or the cap may be simply loosened enough to allow air to pass.

A ball valve cartridge 148 is a separate subassembly which is pushed into the liquid channel 126. In the cartridge, the obstacles at 152 prevent the ball 149 from escaping while enabling liquid to flow out of liquid channel 126 and into the spray chamber 144. Ball 149 rests against an annular seat 150 to prevent liquid in spray chamber 144 from back flowing into the liquid channel 126.

In operation, before the cap 107 is placed over neck 104, any suitable liquid 156 is poured into the bottle in order to fill it to an appropriate level. Then, the cap 107 is turned, snapped, bonded, or otherwise put into place over neck 104. When the spray bottle is ready to be used, at least the bulb 130 is initially squeezed. The memory of the plastic restores the chamber 130 to its full and original volume. In doing so, the liquid is sucked up tube 110 to fill and prime chamber 130 (Arrow B). The ball valve 124 seats itself at the bottom of the funnel shaped chamber 122 to prevent any back flow of the liquid into tube 110.

With the chamber 130 primed, the bottle is now ready for use. To expel a spray, both bulbs 130, 132 are squeezed simultaneously. The liquid stored in chamber 130 is expelled into the spout channel 126. Ball valve 124 prevents the liquid from re-entering the bottle, while ball valve 149 permits the liquid to enter spray chamber 144.

The air in bulb 132 is compressed and expelled (Arrows C, D) into the air channel 136. The compressed air blows the flap valve 146 open so that the compressed air mixes and atomizes with the liquid in spray chamber 144. Together, the air and liquid issue as a mist from nozzle 147. One squeeze will produce a relatively large quantity of liquid and with much less noise than prior squeeze bottles. The flap valve 146 prevents a back flow into channel 136 during spraying.

The bulbs 130, 132 are released by the hand which is spraying the liquid from the bottle. The memory of the plastic causes the bulbs to return to their full volume. The ball 149 closes against the seat 150 so that the liquid which is sucked up the tube 110 and past ball valve 124 fills and primes the bulb 130.

In the absence of the squeezing, there is enough leakage around the flap valve 146 to allow air to enter the bottle, and replenish the air that was expelled during the spraying. Considering the time which normally elapses between the successive squeezes of the bulbs, usually there is an adequate amount of time for the bulb 132 to expand, fill with air, and be ready for the next use.

Figure 2:
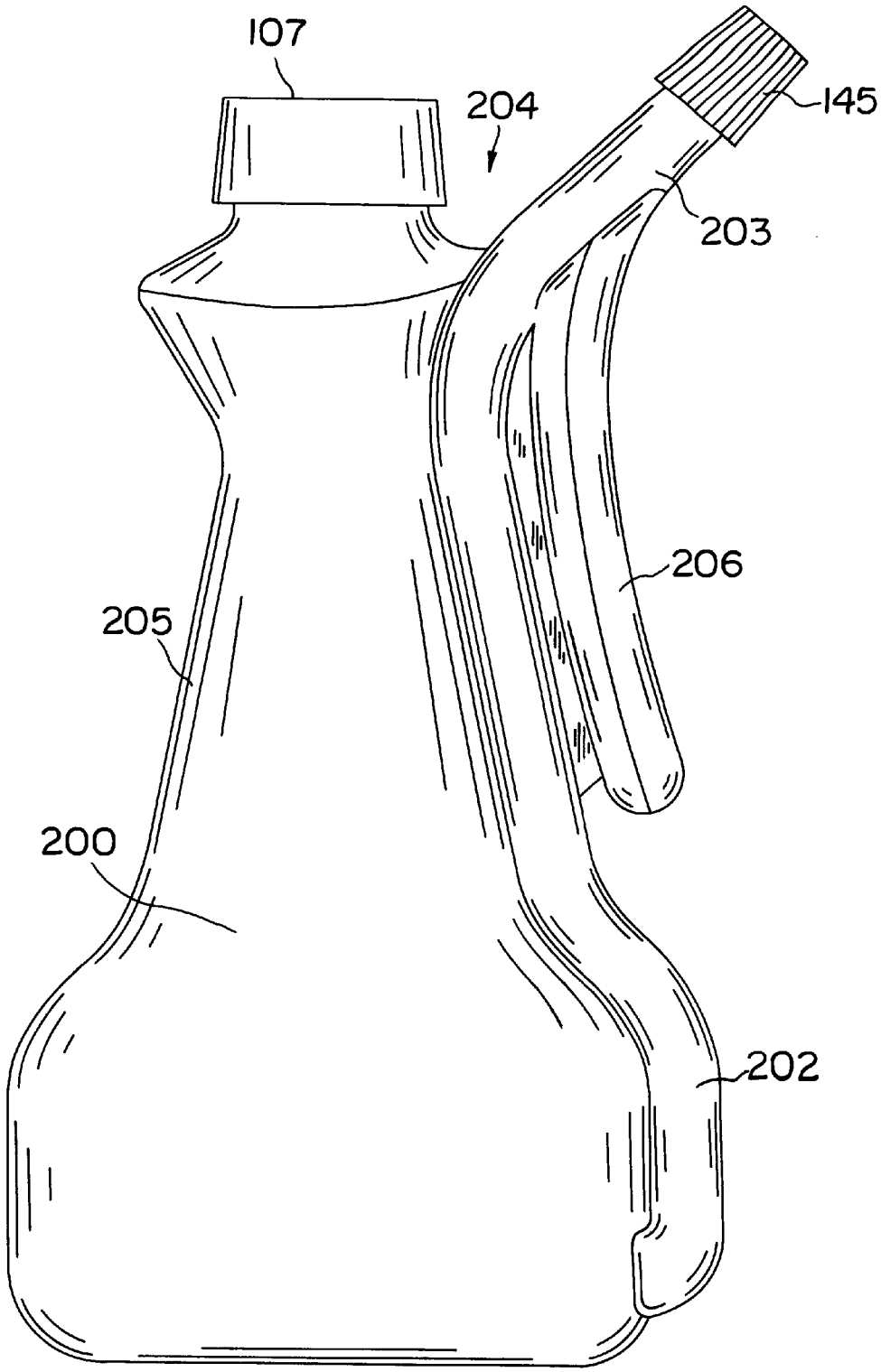
FIG. 2 is a side elevation of a second embodiment of the invention.

FIG. 2 is an exterior showing of a spray bottle 200 with a tube 202 molded therein. The tube extends up the sidewall 205 of the bottle and then flares outwardly into a spout 203 at 204 to give a smooth transition for providing a spray. Since there are no abrupt bends in the passageway from tube 202 to nozzle 145, the liquid flows smoothly and without turbulence from bottle 200 to nozzle 145. The longitudinal axis of spout 203 is preferably inclined at other than a 90° angle relative to the longitudinal axis of sidewall 205 to direct the sprayed liquid at other than a 90° angle.

The liquid chamber or bulb 206 extends downwardly from the spout 203. The embodiment of FIG. 2 does not have an air compressing bulb comparable to bulb 132. However, such a bulb may be added to the bottle 200, if it should be desirable to do so. Otherwise, the interior construction of the FIG. 2 embodiment is substantially the same as the construction of FIG. 1.

Figure 3:
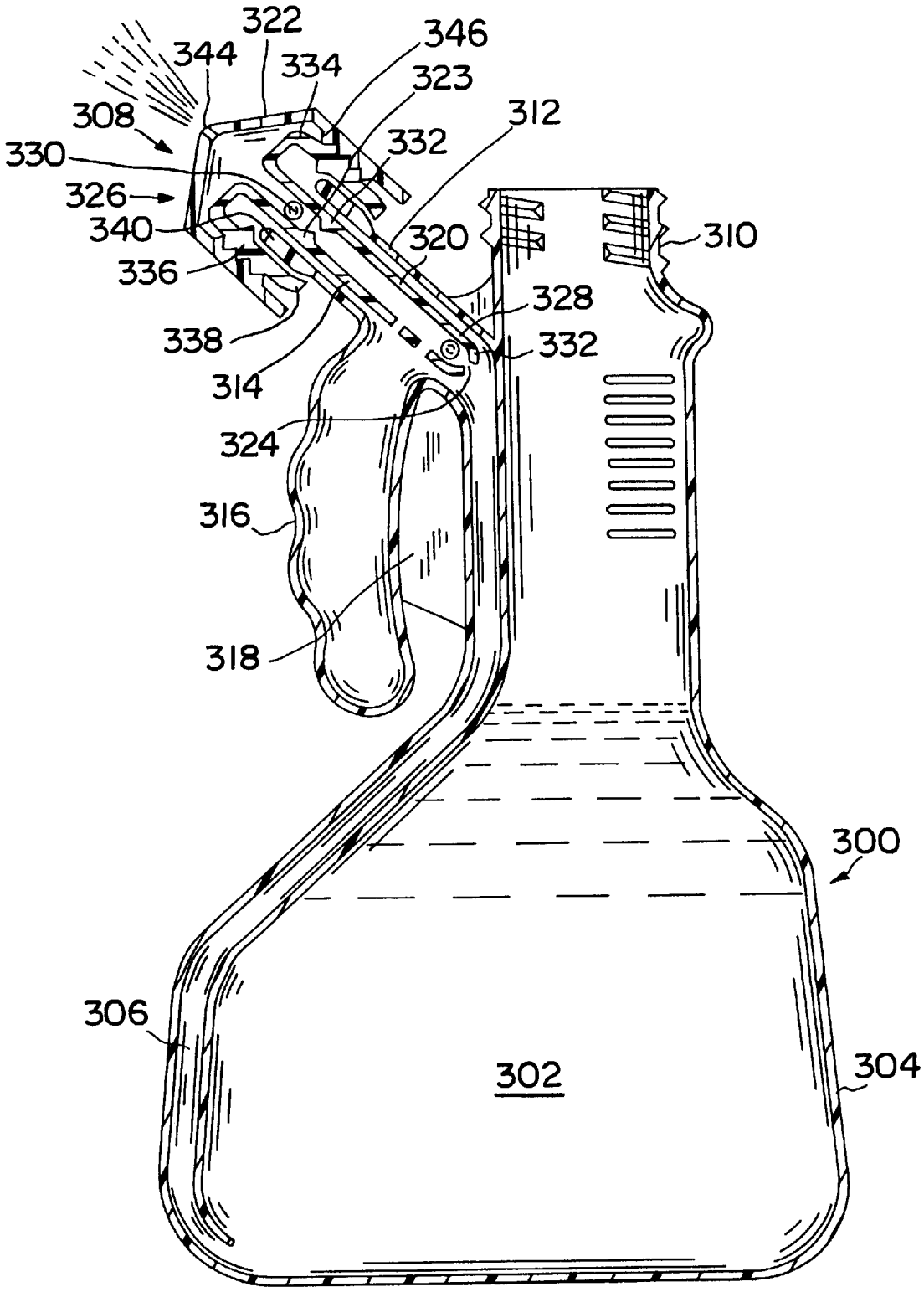
FIG. 3 is a cross-section of a third embodiment of the invention.

The embodiment of FIG. 3 is similar to that of FIGS. 1 and 2 insofar as the bottle 300 includes a liquid chamber 302 formed by bottle sidewall 304, and a tube 306 extends outside of sidewall 304 from the bottom of bottle 300 to spray head 308. Also, like the previous embodiments, the longitudinal axis of spray head 308 is inclined relative to the longitudinal axis of bottle sidewall 304 at an angle substantially different than 90° . Further, the neck 310 of bottle 300 is internally unobstructed for filling the bottle with liquid, and the neck opening 311 is separate and spaced apart from the spray head 308. Thus, there is no need for a complicated cap structure over neck opening 311 that permits both filling and dispensing of liquid.

This embodiment of the invention includes a spray head 308 formed from the combination of the inclined top end portion 312 of tube 306 and a cartridge 314 partially and telescopically received within end portion 312. A squeeze bulb 316 extends downwardly from end portion 312 and is in liquid communication with both it and cartridge 314. Squeeze bulb 316 extends roughly parallel to bottle neck 310 and to that portion of tube 306 which conforms to neck 310, but squeeze bulb 316 is separated from tube 306 by a pinched and solid or thickened plastic region 318.

Cartridge 314 receives liquid from squeeze bulb 316 and dispenses the liquid out from the bottle. Cartridge 314 includes a tube section 320 and a connected nozzle cap 322 at the distal end 326 of tube section 320 remote from bottle sidewall 304. Tube section 320 includes a pair of valves 323, 324, one at the distal end 326 and one at the proximal end 328 nearest bottle sidewall 304. These valves are shown as ball valves in FIG. 3; other types of valves well known in the art could also be used. The valves include balls 330 and constrictions 332 in tube 320.

The distal end 326 of tube section 320 terminates in a splayed end 334 that has threads 336 extending circumferentially and externally around splayed end 334. Splayed end 334 also has a prong 338 extending circumferentially and internally, so that prong 338 faces inclined end portion 312 of tube 306. Splayed end 334 gradually narrows in diameter slightly as it approaches inclined end portion 312, thereby permitting a snap-fit engagement of cartridge 314 with the thickened wall 340 of inclined end portion 312. The combination of the thickened wall 340, the narrowed diameter of splayed end 334, and the prong 338 retain cartridge 314 to inclined end portion 312.

Nozzle cap 322 having a liquid dispensing opening 344 attaches to the splayed end 334 with threads 346 designed to engage threads 336 of splayed end 334. Nozzle cap 322 thus defines the exit port for liquid to be dispensed from the bottle. By twisting the nozzle cap, the size of the opening 344 and hence the spray pattern can be adjusted.

The bottle 300 of FIG. 3 is easy to use. A simple bottle cap not shown but similar to cap 107 of FIGS. 1 and 2 is removed from neck opening 311. The liquid chamber 302 is filled with liquid through neck 310. The bottle is grasped so that the user's fingers encircle squeeze bulb 316, with the user's palm around neck 310. The user primes the bottle by tightening the fingers to compress squeeze bulb 316 toward pinched region 318 and neck 310. This action expels air from squeeze bulb 316, and the subsequent release of squeeze bulb 316 creates a temporary vacuum therein which draws liquid from chamber 302 through tube 306 and into squeeze bulb 316. A second squeeze of squeeze bulb 316 forces liquid from squeeze bulb 316 into tube section 320 of cartridge 314, past valve 322 and out of the bottle through nozzle opening 344. Simultaneously, additional liquid from chamber 302 is drawn through tube 306 into squeeze bulb 316 to be dispensed upon the third squeeze. Liquid drawn into squeeze bulb 316 is precluded from re-entering tube 306 upon squeezing by valve 324.

Figure 4:
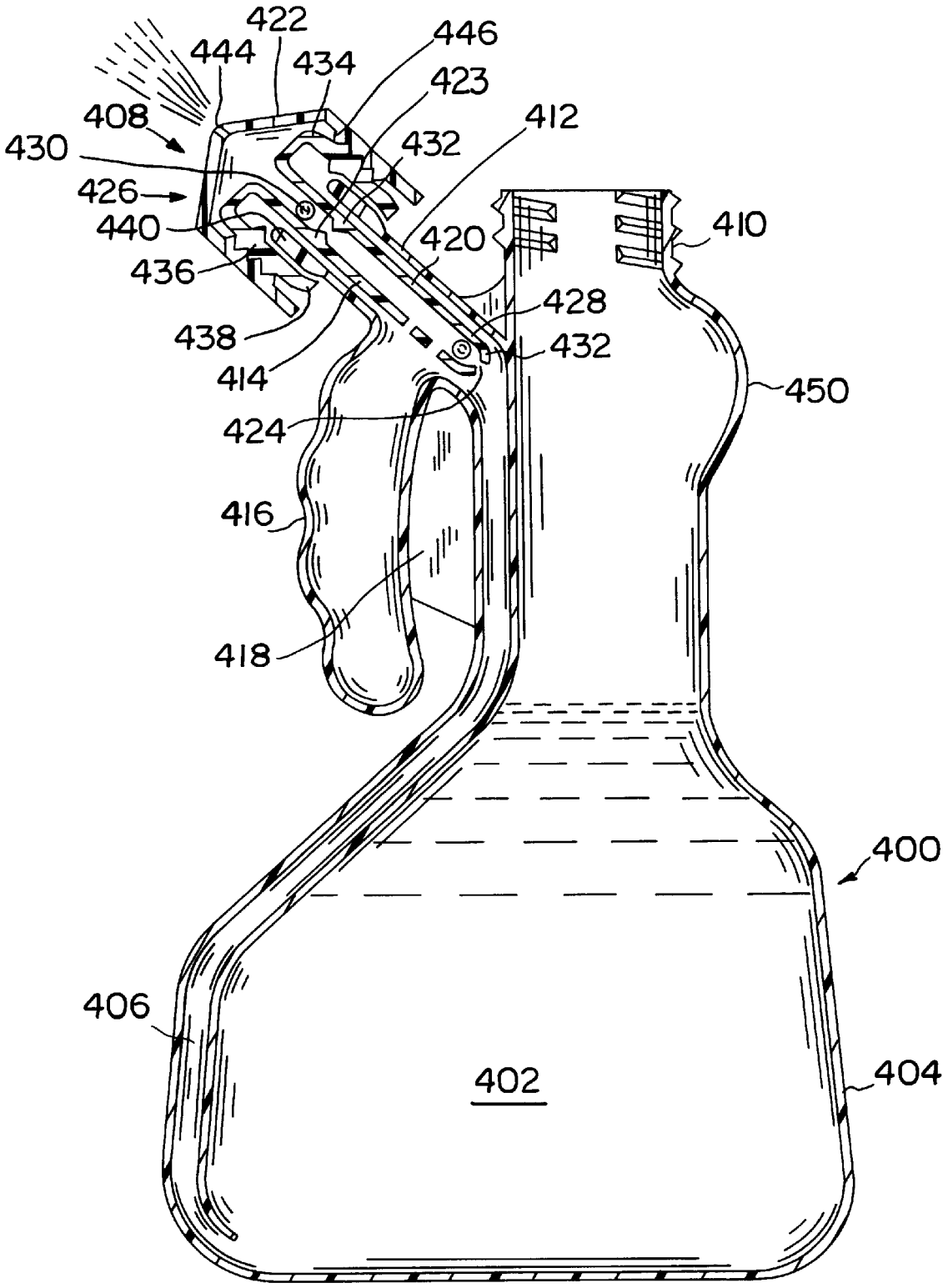
FIG. 4 is a cross section of a fourth embodiment of the invention.

FIG. 4 shows a bottle 400 similar to bottle 300 of FIG. 3, except that the bottle includes a lengthened squeeze bulb or air compressing blister 450 integrally formed along the neck 410, and the neck is smooth without strengthening ribs. Otherwise, the features of FIG. 4 are as described as in FIG. 3 and identified by like reference numerals, except that 400 series numerals are used. This embodiment provides an even greater air jet from the neck area to help atomize the liquid.

While the present invention is described above in connection with preferred or illustrative embodiments, these embodiments are not intended to be exhaustive or limiting of the invention. Rather, the invention is intended to cover all alternatives, modifications, and equivalents included within its spirit and scope, as defined by the appended claims.

What is claimed is:

1. A plastic bottle for spraying liquid comprising:

a sidewall forming a liquid chamber, and having a neck, a neck opening for receiving liquid, and a longitudinal axis extending through said neck;

a tube integrally formed to said sidewall and in communication with the liquid chamber for receiving liquid from said chamber, said tube extending from a bottom of said chamber alongside the sidewall and toward said neck, said tube having a bottom end in liquid communication with said liquid chamber and a top end inclined away from said neck;

a squeeze bulb in communication with said tube for receiving liquid from said tube, said squeeze bulb integrally formed with said tube near said top end of said tube;

said top end of said tube having a longitudinal axis inclined a relative to said longitudinal axis of said bottle sidewall at an angle other than 90°;

means in said tube for preventing a back-flow of liquid into said liquid chamber via said tube when said squeeze bulb is squeezed; and a nozzle on said top end of said tube for dispensing liquid from said tube.

2. The plastic bottle of claim 1 wherein said squeeze bulb is separated from said bottom end of said tube by a pinched plastic region.

3. The plastic bottle of claim 1 and a cartridge telescopically received by said top end of said tube and connected to said nozzle.

4. The plastic bottle of claim 3 wherein said means for preventing back-flow of liquid is located within said cartridge.

5. The plastic bottle of claim 4 wherein said squeeze bulb is in liquid communication with said cartridge.

6. A plastic blow molded spray bottle, said plastic having a memory which restores it to its blow molded shape, said bottle comprising a chamber for receiving fluid, a top for closing said chamber, a tube communicating with a bottom area of said chamber, said tube being formed along a side of said chamber but not through said top by pinch molding a solid plastic strip between said bottle and said tube, a squeeze bulb integrally formed on said bottle and communicating with a top of said tube for drawing liquid from said chamber and up said tube responsive to a squeezing of said bulb, a nozzle communicating with said bulb for expelling said liquid drawn up said tube into the ambient atmosphere, a pair of check valves for guiding and directing said fluid as it flows from said chamber into said atmosphere, and means for introducing air into said bottle responsive to a release of said squeezed bulb.

7. The bottle of claim 6 wherein said bottle contains a check valve for preventing air from leaving said bottle when said bulb is squeezed and for admitting air into said bottle when said bulb is released from a squeeze condition.

8. The bottle of claim 6 wherein said tube is directed along a path which is substantially free of sharp bends to reduce turbulence within said tube.

* * * * *